US008721394B2

(12) United States Patent
Wang

(10) Patent No.: US 8,721,394 B2
(45) Date of Patent: May 13, 2014

(54) POLISHING PAD AND POLISHING METHOD

(75) Inventor: Yu-Piao Wang, Jhubei (TW)

(73) Assignee: IV Technologies Co., Ltd., Taiching (TW)

( * ) Notice: Subject to any disclaimer, the term of this patent is extended or adjusted under 35 U.S.C. 154(b) by 1533 days.

(21) Appl. No.: 11/960,451

(22) Filed: Dec. 19, 2007

(65) Prior Publication Data

US 2009/0104849 A1 Apr. 23, 2009

(30) Foreign Application Priority Data

Oct. 18, 2007 (TW) ..... 96139014 A

(51) Int. Cl.
*B24B 1/00* (2006.01)
*B24D 11/00* (2006.01)

(52) U.S. Cl.
USPC ..... 451/56; 451/527; 451/529; 451/539

(58) Field of Classification Search
USPC ..... 451/527–530, 533, 539
See application file for complete search history.

(56) References Cited

U.S. PATENT DOCUMENTS 5,984,769 A 11/1999 Bennett et al.
6,165,904 A * 12/2000 Kim ..... 438/692
6,273,806 B1 8/2001 Bennett et al.
7,217,179 B2 5/2007 Sakurai et al.
2004/0014413 A1 1/2004 Kawahashi et al.
2004/0224622 A1 * 11/2004 Sakurai et al. ..... 451/526
2006/0229002 A1 10/2006 Muldowney
2007/0032182 A1 * 2/2007 Suzuki ..... 451/527
2008/0313967 A1 * 12/2008 Sakurai et al. ..... 51/298
2009/0075568 A1 * 3/2009 Kimura et al. ..... 451/59

FOREIGN PATENT DOCUMENTS

CN 1760240 A 4/2006
TW 513338 B 12/2002
TW I250572 B 3/2006
TW I274631 B 3/2007

OTHER PUBLICATIONS

Office Action for corresponding Taiwanese Patent Application No. 10221096770, dated Aug. 22, 2013, 9 pages.
Chinese Office Action for Chinese Application No. 200710185026.8 dated Mar. 22, 2012, pp. 1-5.

* cited by examiner

*Primary Examiner* — Maurina Rachuba
(74) *Attorney, Agent, or Firm* — Ditthavong Mori & Steiner, P.C.

(57) ABSTRACT

A polishing pad and a polishing method for polishing a substrate are described. The polishing pad includes a polishing layer and at least two grooves. The grooves form polishing tracks respectively. The polishing tracks collectively construct an even tracking zone. A better polishing uniformity of a substrate surface is achieved with the even tracking zone.

60 Claims, 9 Drawing Sheets

POLISHING PAD AND POLISHING METHOD

BACKGROUND OF THE INVENTION

1. Field of the Invention

The present invention relates to a polishing pad and a polishing method. More particularly, the present invention relates to a polishing pad and a polishing method capable of achieving a better polishing uniformity of a substrate surface.

2. Description of Related Art

As progressing of industries, devices of integrated circuits, microelectromechanical systems, power conversion, communications, storage disks, and displays are becoming more and more advanced and complex. In order to ensure the reliability of the devices, the surface of substrates (e.g., semiconductor wafers, III-V wafers, storage device carriers, ceramic substrates, polymer substrates, and glass substrates) for fabricating these devices must be smooth and even.

Among the planarization processes, a polishing process is often adopted in the industry. Generally speaking, in the polishing process, a pressure is applied on a substrate, so as to press the substrate on a polishing pad, and a relative motion between the substrate and the polishing pad is provided. Through the friction generated by the relative motion, a portion of the substrate surface is removed, such that the surface is planarized gradually.

FIG. 1 is a schematic top view of a conventional polishing pad. The polishing pad 100 includes a polishing layer 110 and a plurality of circumferential grooves 120. The polishing layer 110 is in contact with a surface of a substrate 130. The plurality of circumferential grooves 120 are arranged in concentric circles, and a center of the circumferential grooves 120 coincides with a rotational axis $C_0$ of the polishing pad 100. The circumferential grooves 120 are used to accommodate or remove the polishing residues or byproducts, and enable the substrate 130 to be easily detached away from the polishing pad 100 when the polishing is completed.

During polishing, in addition to the rotation of the polishing pad 100, the substrate 130 on the surface of the polishing pad 100 rotates as well, expecting that all positions of the surface of the substrate 130 are able to contact with the circumferential grooves 120. However, since the circumferential grooves 120 of the conventional polishing pad 100 are concentric circular grooves, and the substrate 130 rotates around its central axis, when a specific point of the substrate 130 moves to a region parallel to tangential direction of the grooves 120, the specific point will be constantly on the groove portion or the non-groove portion. For example, when the specific point is on the groove portion, points near the specific point will be constantly on the non-groove portion, which results in an unfavorable polishing uniformity. In addition, the closer the position is to the central portion of the substrate 130, the more serious the uniformity problem will be. In the entire polishing process, the central portion of the substrate 130 is almost constantly in contact with a specific portion (e.g., the groove portion or the non-groove portion) on the polishing pad 100. Therefore, the polishing rate at the central portion of the substrate 130 will be lower or higher than the polishing rate of other near portions, depending on whether the central portion is constantly positioned on the groove portion or the non-groove portion. The problem that the polishing rate of the substrate 130 is not uniform may eventually suffer the reliability of the devices.

Thus, a polishing pad providing a better polishing uniformity is needed.

SUMMARY OF THE INVENTION

Accordingly, the present invention is directed to a polishing pad, which enables polishing rates of a substrate surface to have a better uniformity.

The present invention is also directed to a polishing method, which helps to obtain a substrate with a planar surface.

The present invention provides a polishing pad suitable for polishing a substrate. The polishing pad includes a polishing layer and at least two grooves. The polishing layer has an even tracking zone disposed around a rotational axis. The grooves are disposed in the even tracking zone, and satisfy the following relation:

$$D_{(i)max} \cong D_{(i+n)min}$$

where $D_{(i)max}$ is the largest distance from the rotational axis to the $(i)^{th}$ groove; $D_{(i+n)min}$ is the smallest distance from the rotational axis to the $(i+n)^{th}$ groove; i is an ordinal number of a groove counting from the groove closest to the rotational axis to an outer periphery of the even tracking zone, and n is an integer.

The present invention further provides a polishing pad suitable for polishing a substrate. The polishing pad includes a polishing layer and at least two grooves. The polishing layer has an even tracking zone. The grooves are disposed in the even tracking zone. Each of the grooves forms one polishing track, and the polishing tracks are adjoining one another.

The present invention still provides a polishing pad suitable for polishing a substrate. The polishing pad includes a polishing layer. The polishing layer has an even tracking zone. The even tracking zone is divided into at least two polishing tracks, and the polishing tracks are adjoining one another. In addition, at least one groove is disposed in each of the polishing tracks, and the at least one groove has a uniformly distributed trajectory in each of the polishing tracks.

The present invention also provides a polishing method for polishing a substrate. Firstly, a polishing pad is provided. Then, a pressure is applied on the substrate to press the substrate on the polishing pad. Next, a relative motion is provided between the substrate and the polishing pad. The polishing pad includes a polishing layer and at least two grooves. The polishing layer has an even tracking zone disposed around a rotational axis. The grooves are disposed in the even tracking zone, and satisfy the following relation:

$$D_{(i)max} \cong D_{(i+n)min}$$

where $D_{(i)max}$ is the largest distance from the rotational axis to the $(i)^{th}$ groove; $D_{(i+n)min}$ is the smallest distance from the rotational axis to the $(i+n)^{th}$ groove; i is an ordinal number of a groove counting from the groove closest to the rotational axis to an outer periphery of the even tracking zone, and n is an integer.

The present invention further provides a polishing method for polishing a substrate. Firstly, a polishing pad is provided. Then, a pressure is applied on the substrate to press the substrate on the polishing pad. Next, a relative motion is provided between the substrate and the polishing pad. The polishing pad includes a polishing layer and at least two grooves. The polishing layer has an even tracking zone. The grooves are disposed in the even tracking zone. Each of the grooves forms one polishing track, and the polishing tracks are adjoining one another.

The present invention still provides a polishing method for polishing a substrate. Firstly, a polishing pad is provided. Then, a pressure is applied on the substrate to press the substrate on the polishing pad. Next, a relative motion is provided between the substrate and the polishing pad. The polishing pad includes a polishing layer. The polishing layer has an even tracking zone. The even tracking zone is divided into at least two polishing tracks, and the polishing tracks are adjoining one another. At least one groove is disposed in each of the polishing tracks, and the at least one groove has a uniformly distributed trajectory in each of the polishing tracks.

The polishing pad and the polishing method of the present invention adopt the polishing pad with a specific groove design, so a polishing process using the polishing pad may achieve a better polishing uniformity of a polished substrate surface.

In order to make the aforementioned features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIGS. 3A to 3F are schematic top views of patterns of grooves according to several embodiments of the present invention.

DESCRIPTION OF EMBODIMENTS

The polishing method of the present invention is suitable for polishing a substrate. Firstly, a polishing pad is provided. The polishing pad, for example, has a specific groove design, in which each groove forms a corresponding polishing track, and the polishing tracks form an even tracking zone. Then, a pressure is applied on the substrate to press the substrate on the polishing pad. Next, a relative motion is provided between the substrate and the polishing pad, so as to remove a portion of a substrate surface to achieve planarization. As the polishing pad has the even tracking zone, the polishing method of the present invention may achieve a better polishing uniformity of the substrate surface. In addition, according to the polishing method of the present invention, slurry or solution may be optionally supplied during polishing. Thus, the polishing method becomes a chemical mechanical polishing (CMP) process.

The polishing pads with specific groove designs of the polishing method will be described below. Persons skilled in the art can implement the present invention according to the following detailed description of the present invention, which, however, does not intend to limit the scope of the present invention.

Figure 1:
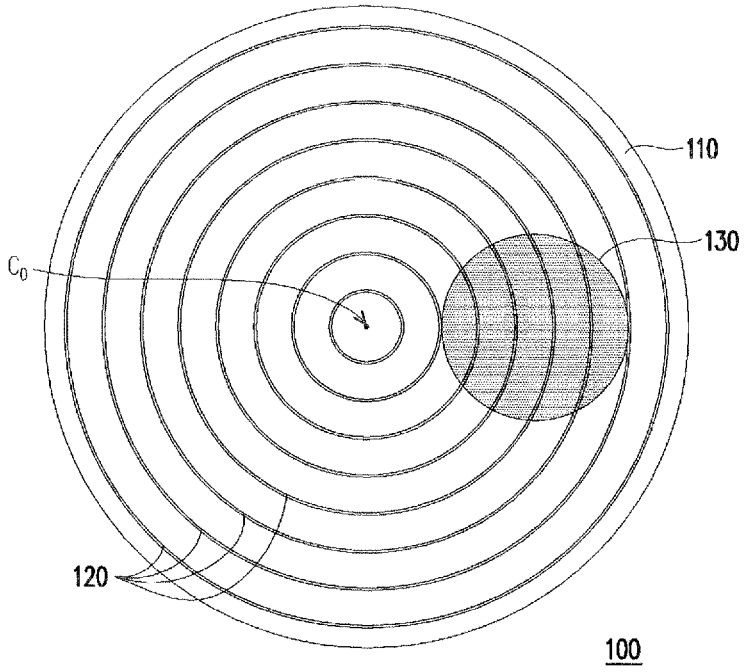
FIG. 1 (PRIOR ART)
FIG. 1 is a schematic top view of a conventional polishing pad.
Figure 2A:
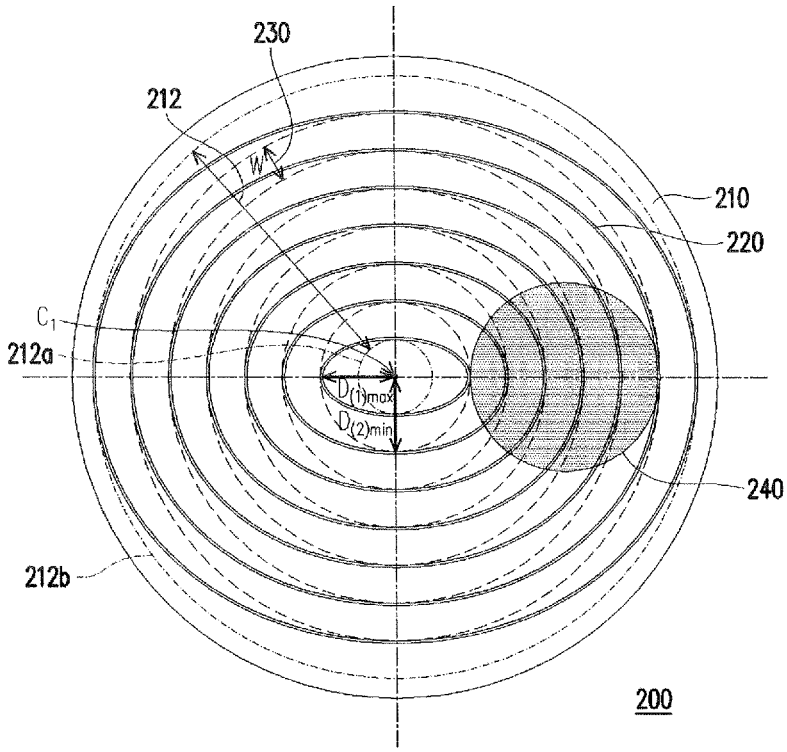
FIG. 2A is a schematic top view of a polishing pad according to an embodiment of the present invention.

FIG. 2A is a schematic top view of a polishing pad according to an embodiment of the present invention. Referring to FIG. 2A, the polishing pad 200 is suitable for polishing a surface of a substrate 240 during polishing. The polishing pad 200, for example, is made of a polymer base material, and the polymer base material may be polyester, polyether, polyurethane, polycarbonate, polyacrylate, polybutadiene, or other polymer base materials formed by appropriate thermosetting resins or thermoplastic resins. In addition to the polymer base material, the polishing pad 200 may further include conductive materials, abrasives, or soluble additives in the polymer base material.

The polishing pad 200 includes a polishing layer 210 and at least two grooves 220. The polishing layer 210 has an even tracking zone 212. The even tracking zone 212 is an area formed by uniformly distributed trajectories along which the grooves 220 relatively pass when the polishing pad 200 rotates. In one embodiment, the even tracking zone 212, for example, is disposed corresponding to a central portion of the substrate 240. The even tracking zone 212, for example, is disposed around a rotational axis $C_1$. The rotational axis $C_1$ extends in a direction perpendicular to the polishing layer 210. In detail, as shown in FIG. 2A, the even tracking zone 212 is substantially disposed in a middle region between the innermost portion and the outermost portion of the polishing pad 200, i.e., in an area between a border 212*a* and a border 212*b*. The even tracking zone 212, for example, is annular, and has a geometrical center coinciding with the rotational axis $C_1$. In the entire polishing process of this embodiment, the central portion of the substrate 240 will alternately pass the groove portion and the nor-groove portion instead of constantly contacting the groove portion or the non-groove portion on the polishing pad 200. Therefore, the polishing rates of the central portion and other near portions of the substrate 240 are more consistent.

In one embodiment, the even tracking zone 212 has a width of at least 35 mm, for example, between 40 mm and a maximum dimension of the substrate 240. In addition, other grooves may also be disposed in the portion outside the even tracking zone 212. The even tracking zone 212 may also be optionally disposed in almost entire surface of the polishing pad 200. For example, the width of the even tracking zone 212 may be up to 95% of a radius of the polishing pad 200.

The grooves 220 are disposed in the even tracking zone 212. The grooves 220, for example, are enclosed grooves, and are not interconnected. Moreover, each of the grooves 220, for example, forms one polishing track 230, and the polishing tracks 230 collectively construct the even tracking zone 212. A better polishing uniformity of the surface of the substrate 240 is achieved with the even tracking zone 212.

In this embodiment, the grooves 220 are elliptical grooves, and the grooves 220, for example, have a common geometrical center. That is to say, the geometrical center of the elliptical grooves coincides with the rotational axis $C_1$. As shown in FIG. 2A, a major axis of each elliptical groove, for example, is set on the same axis, i.e., the grooves 220 are coaxial. Moreover, for example, the radial pitches between the grooves 220 are the same. In addition, when the polishing pad 200 rotates about the rotational axis $C_1$, each of the grooves 220 will generate one polishing track 230. The polishing tracks 230 are concentric with the rotational axis $C_1$. Furthermore, the polishing tracks 230 are adjoining one another. For example, the polishing tracks 230 have the same width W. In other words, the even tracking zone 212, for example, is divided into at least two polishing tracks 230 adjoining one another, and at least one groove 220 is disposed in each of the polishing tracks 230, such that the at least one groove 220 may form a uniformly distributed trajectory in each of the polishing tracks 230.

As the polishing tracks 230 generated corresponding to the grooves 220 are adjoining one another in this embodiment, when the substrate 240 is polished, the polishing pad 200 may provide a uniform polishing rate on every portion of the surface of the substrate 240.

It should be noted that the grooves 220 satisfy the following relation:

$$D_{(i)max} \cong D_{(i+n)max}$$

where $D_{(i)max}$ is the largest distance from the rotational axis $C_1$ to the $(i)^{th}$ groove 220; $D_{(i+n)min}$ is the smallest distance from the rotational axis $C_1$ to the $(i+n)^{th}$ groove 220; i is an ordinal number of a groove 220 counting from the groove 220 closest to the rotational axis $C_1$ to an outer periphery of the even tracking zone 212, and n is an integer between 1 and 5, for example. In other words, the largest distance $D_{(i)max}$ from the rotational axis $C_1$ to the $(i)^{th}$ groove 220 is approximately equal to or substantially equal to the smallest distance from the rotational axis $C_1$ to the $(i+n)^{th}$ groove 220.

For example, as shown in FIG. 2A, for example n=1, the grooves 220 satisfies the relation: $D_{(i)max} \cong D_{(i+1)min}$. When i=1, $D_{(1)max} \cong D_{(2)min}$; when i=2, $D_{(2)max} \cong D_{(3)min}$; other situations when i=3, 4, 5, . . . can be derived in the same way. That is, as shown in FIG. 2A, the largest distance $D_{(1)max}$ from the rotational axis $C_1$ to the first groove 220 is the major axis of the first groove 220, and the smallest distance $D_{(2)min}$ from the rotational axis $C_1$ to the second groove 220 is the minor axis of the second groove 220, wherein $D_{(1)max} \cong D_{(2)min}$. Moreover, in this embodiment, the polishing tracks 230 formed by the grooves 220 are adjoining one another to construct the even tracking zone 212, i.e., no non-track region is formed between the polishing tracks 230.

Figure 2B:
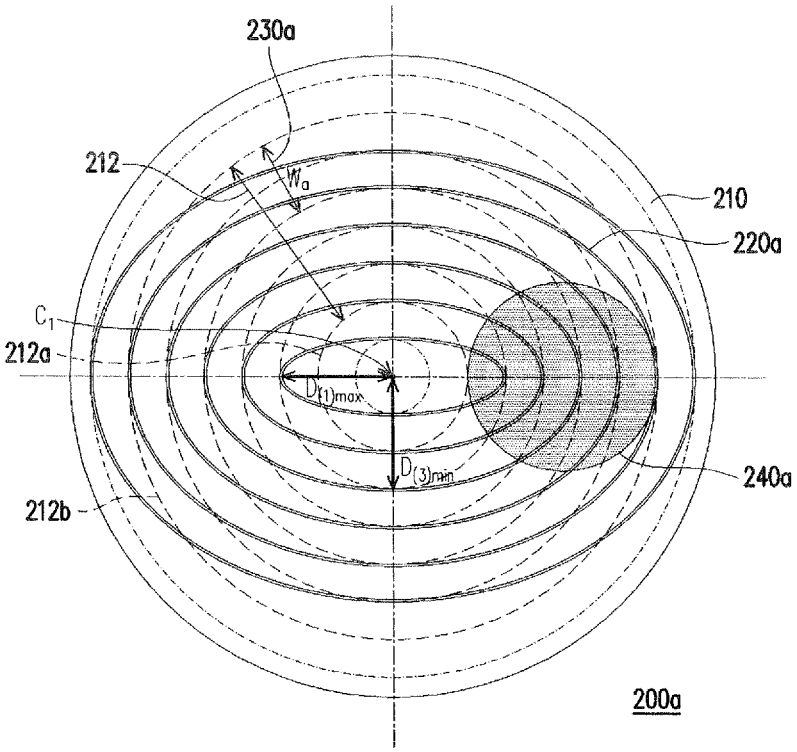
FIG. 2B is a schematic top view of a polishing pad according to another embodiment of the present invention.

In FIG. 2A, n=1 is taken as an example, but the present invention is not limited to this. FIG. 2B is a schematic top view of a polishing pad according to another embodiment of the present invention. In the polishing pad 200*a* of FIG. 2B, n=2 is taken as an example, and grooves 220*a* satisfy the relation: $D_{(i)max} \cong D_{(i+2)min}$. As shown in FIG. 2B, the largest distance $D_{(1)max}$ from the rotational axis $C_1$ to the first groove 220*a* is the major axis of the first groove 220*a*, and the smallest distance $D_{(3)min}$ from the rotational axis $C_1$ to the third groove 220 is the minor axis of the third groove 220, wherein $D_{(1)max} \cong D_{(3)min}$. In this embodiment, the polishing tracks 230*a*, for example, have a width of $W_a$. Different from the grooves 220 shown in FIG. 2A, the grooves 220*a* in FIG. 2B are elliptical grooves in which the major axis and the minor axis differ more. Therefore, the polishing tracks 230*a* generated corresponding to the grooves 220*a* may have a larger width $W_a$, and the polishing tracks 230*a* may be partially overlapped one another. Areas of the same overlapping ratio (areas between the border 212*a* and the border 212*b*) of the polishing tracks 230*a* construct the even tracking area 212. A better polishing uniformity of the surface of the substrate 240*a* is achieved with the even tracking zone 212.

It should be noted that in the above embodiments, the polishing pads 200, 200*a* with elliptical grooves are exemplified for illustration, but the present invention is not limited to this. In other embodiments, the grooves may also be in other shapes. Hereinafter, the grooves of different patterns will be illustrated.

FIGS. 3A to 3E are schematic top views of groove patterns according to several embodiments of the present invention. In FIGS. 3A to 3F, the same components in FIG. 2 are indicated by the same reference numerals, and will not be described again. Moreover, in order to simplify the figures, only two grooves are shown, which satisfy the condition of n=1 in the above relation, which are provided for persons skilled in the art to implement the present invention, and are not intended to limit the scope of the present invention.

Figure 3A:
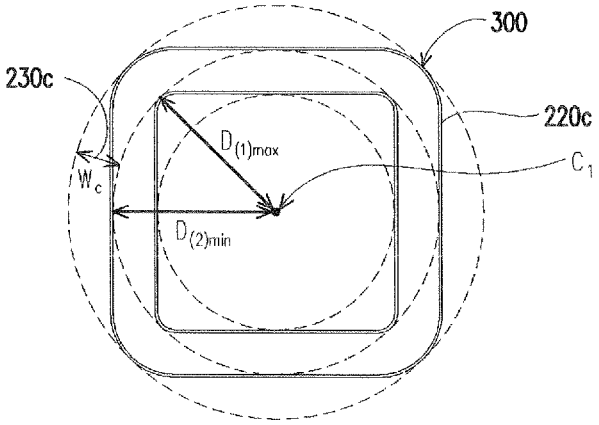

As shown in FIG. 3A, the grooves 220*c*, for example, are polygonal grooves. In one embodiment, the grooves 220*c* are quadrangular grooves with four round corners 300. The grooves 220*c* thus will form the polishing tracks 230*c* with a width $W_c$ and adjoining one another. The polishing tracks 230*c* collectively construct the even tracking zone. A better polishing uniformity of the substrate surface is achieved with the even tracking zone.

Figure 3B:
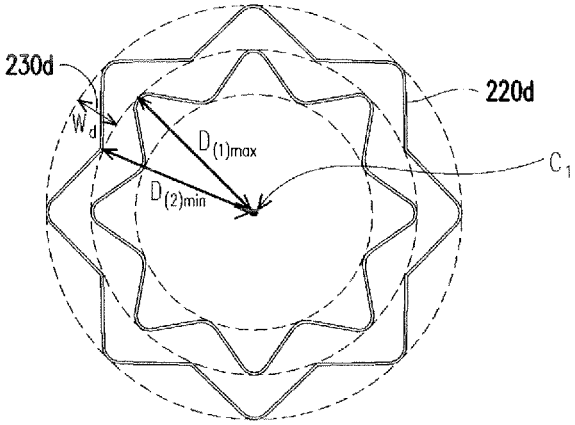

In addition, the grooves 220*d* may also be corrugated grooves with a plurality of round corners as shown in FIG. 3B. The corrugated grooves thus form the polishing tracks 230*d* with a width $W_d$ and adjoining one another. The polishing tracks 230*d* collectively construct the even tracking zone. A better polishing uniformity of the substrate surface is achieved with the even tracking zone.

Figure 3C:
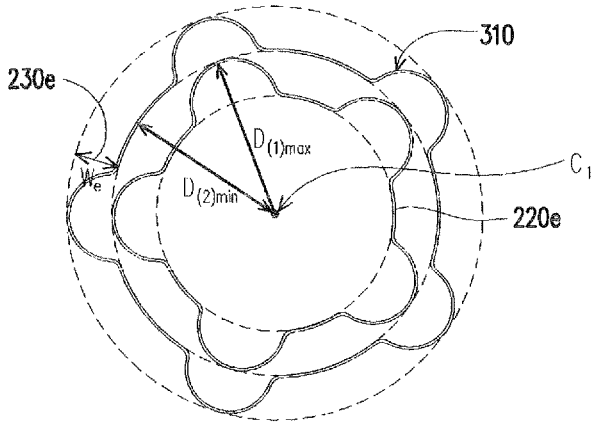

In another embodiment, the grooves 220*e* may be annular grooves having at least one protrusion and/or at least one recession. As shown in FIG. 3C, the grooves 220*e*, for example, are a plurality of annular grooves having a plurality of protrusions 310, and the protrusions 310 protrude from projected peripheries of the annular grooves. The annular grooves having the protrusions 310, for example, will from polishing tricks 230*e* with a width $W_c$ and adjoining one another. The polishing tracks 230*e* collectively construct the even tracking zone. A better polishing uniformity of the substrate surface is achieved with the even tracking zone.

Figure 3D:
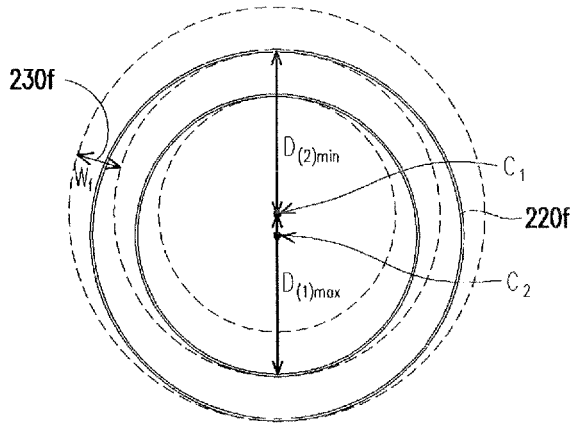

As shown in FIG. 3D, the grooves 220*f* may also be circumferential grooves with a geometrical center, for example, deviated from the rotational axis $C_1$. In one embodiment, the grooves 220*f* are circular grooves with a center $C_2$ deviated from the rotational axis $C_1$, i.e., the center $C_2$ does not coincide with the rotational axis $C_1$. As the center $C_2$ of the grooves 220*f* is deviated from the rotational axis $C_1$, the grooves 220*f* will form polishing tracks 230*f* with a width $W_f$ and adjoining one another. The polishing tracks 230*f* collectively construct the even tracking zone. A better polishing uniformity of the substrate surface is achieved with the even tracking zone.

Figure 3E:
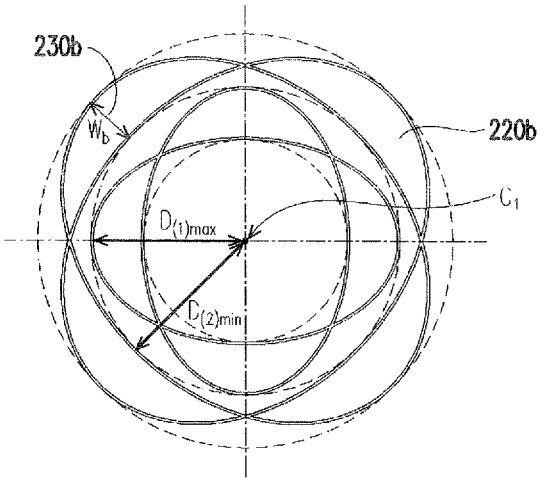

In one embodiment, at least two grooves may be formed in a polishing track, and the grooves may be optionally arranged in symmetry. As shown in FIG. 3E, the grooves 220*b* in each of the polishing tracks 230*b* may include two intersecting elliptical grooves with the same length of major axis and the same length of minor axis. The major axes of the two elliptical grooves may be perpendicular to each other. In other words, the grooves 220*b*, for example, are dual-elliptical grooves formed by two elliptical grooves. The grooves 220*b* will form polishing tracks 230*b* with a width $W_b$ and adjoining one another. The polishing tracks 230*b* collectively construct the even tracking zone. A better polishing uniformity of the substrate surface is achieved with the even tracking zone.

It should be noted that as shown in FIGS. 3A to 3E, the largest distance from the rotational axis $C_1$ to the first groove 220*c*, 220*d*, 220*e*, 220*f*, and 220*b* is equal to the smallest distance from the rotational axis $C_1$ to the second groove 220*c*, 220*d*, 220*e*, 220*f*, and 220*b*. In other words, the grooves 220*c*, 220*d*, 220*e*, 220*f*, and 220*b* all satisfy the relation $D_{(1)max} \cong D_{(2)min}$. Therefore, the grooves 220*c*, 220*d*, 220*e*, 220*f*, and 220*b* may construct the even tracking zone, so as to provide a better polishing uniformity of the substrate surface.

Definitely, in other embodiments, the grooves of the polishing pad may be in other irregular shapes, or any combination of the grooves 220*c*, 220*d*, 220*e*, 220*f*, and 220*b* in different patterns as shown in FIGS. 3A to 3E, as long as the grooves on the polishing pad satisfy the relation $D_{(i)max} \cong D_{(i+n)min}$. Persons skilled in the art can make proper adjustment according to actual requirements.

It should be noted that in addition to the above embodiments, the present invention may also be implemented in other forms. In the embodiments of FIGS. 2A, 2B and 3A to 3E, the grooves are arranged corresponding to the same axis, the pitches between every two adjoining grooves are the same in radial direction, and the adjoining polishing tracks have the same width. However, the present invention is not limited to this. In other embodiments, the pitches of every two adjoining grooves may be different in the radial direction, which will be illustrated in detail below.

Figure 4:
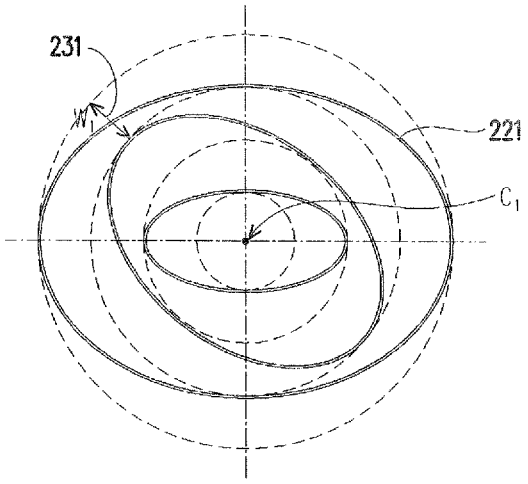
FIG. 4 is a schematic top view of a groove arrangement according to an embodiment of the present invention.

FIG. 4 is a schematic top view of a groove arrangement according to an embodiment of the present invention. In the embodiment, as shown in FIG. 4, different grooves 221 are arranged corresponding to different axes, i.e., the grooves 221 are arranged non-coaxially. The grooves 221 will form polishing tracks 231, and the polishing tracks 231, for example, have the same width $W_1$.

Figure 5A:
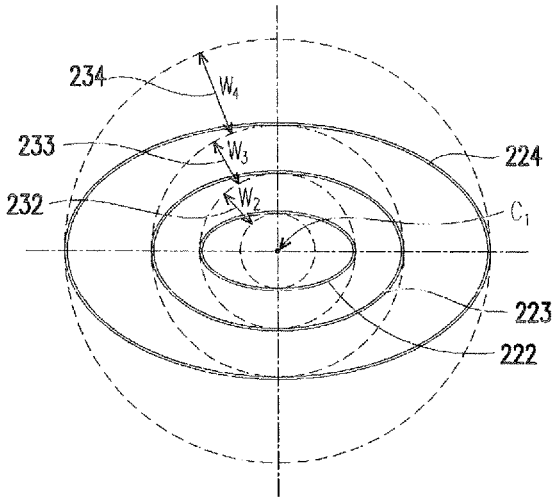
FIGS. 5A and 5B are schematic top views of groove arrangements according to other embodiments of the present invention.
Figure 5B:
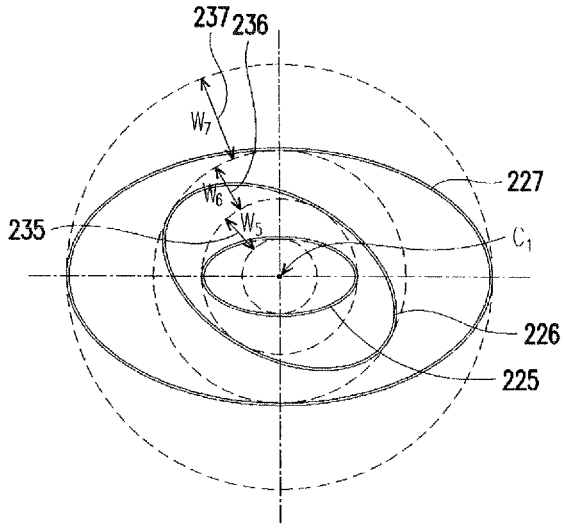

FIGS. 5A and 5B are schematic top views of a groove arrangement according to other embodiments of the present invention. As shown in FIG. 5A, the grooves 222, 223, and 224 are the first, second, and third grooves sequentially counting from the one closest to the rotational axis $C_1$. The grooves 222, 223, and 224 will form polishing tracks 232, 233, and 234 with widths $W_2$, $W_3$, and $W_4$ respectively. In another embodiment, the grooves 222, 223, and 224 are arranged corresponding to the same axis. However, the width $W_2$ of the polishing track 232, the width $W_3$ of the polishing track 233, and the width $W_4$ of the polishing track 234, for example, are not completely the same.

As shown in FIG. 5B, the grooves 225, 226, and 227 are the first, second, and third grooves counting from the one closest to the rotational axis $C_1$ respectively. The grooves 225, 226, and 227 will form polishing tracks 235, 236, and 237 with widths $W_5$, $W_6$, and $W_7$ respectively. In another embodiment, the grooves 225, 226, and 227 are arranged non-coaxially. In addition, the widths W5, W6, and W7 of the polishing tracks 231, 232, and 233, for example, are not completely the same.

Figure 6:
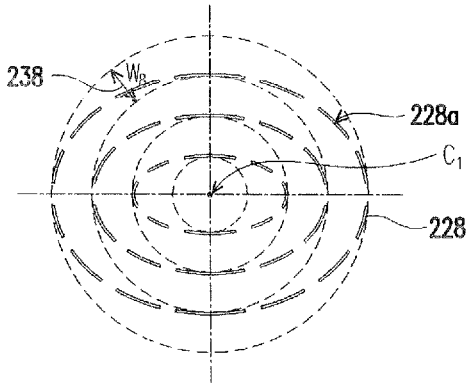
FIG. 6 is a schematic top view of grooves according to still another embodiment of the present invention.

FIG. 6 is a schematic top view of the grooves according to another embodiment of the present invention. Referring to FIG. 6, the grooves 228 on the polishing pad may also include a plurality of discontinuous sub-grooves 228*a*. For example, the grooves 228 are in a discontinuous enclosure shape. Moreover, the sub-grooves 228*a* constructing each of the discontinuous enclosure shape of the grooves 228 will form a polishing track 238 with a width $W_8$. The polishing tracks 238 collectively construct the even tracking zone. A better polishing uniformity of the substrate surface is achieved with the even tracking zone.

It should be noted that as shown in FIGS. 4, 5A, 5B, and 6, the grooves of the above embodiments all satisfy the relation $D_{(i)max} \cong D_{(i+n)min}$. Therefore, during polishing, the polishing tracks formed by the grooves will collectively construct the even tracking zone, which helps to achieve a uniform polishing rate on different portions of the substrate surface.

Moreover, in the embodiments of FIGS. 4, 5A, 5B, and 6, oily three grooves are shown and the elliptical grooves are taken as an example for simplifying the drawings, such that persons skilled in the art can implement the present invention accordingly. However, the present invention is not limited to this. Persons skilled in the art can appreciate the applications and variations of the present invention, which will not be described herein.

In the above embodiments, round polishing pads are taken as an example for illustrating the present invention. However, the present invention is not limited to this. The polishing pads may also in other shapes, e.g., rings, squares, or strips, depending on the requirements of polishing equipment. Moreover, the grooves in the polishing tracks may also be in other shapes, as long as the grooves may construct the even tracking zone and the polishing rate is uniform, which are not particularly limited in the present invention, and persons of ordinary skill in the art can make modifications according to actual requirements.

In one embodiment of the polishing method of the present invention, when slurry or solution is used in polishing, the slurries or solutions with different properties may be supplied in different polishing tracks. The properties, for example, include viscosity of the slurry or solution, concentration of chemicals (e.g., oxidizing agents, reducing agents, complex agents, inhibitors, and catalysts) in the slurry or solution, or solid content or abrasive content in the slurry. In the polishing pads of the above embodiments, the grooves in different polishing tracks are not interconnected, so the polishing capability differs in different polishing tracks, thereby adjusting the polishing rate distribution profile. For example, the slurry containing more abrasives may be optionally supplied into the polishing tracks corresponding to the near edge region of the substrate to increase the polishing rate of the near edge region of the substrate.

In view of the above, the groove design of the polishing pad of the present invention may construct the even tracking zone, and with the even tracking zone, a better polishing uniformity of the substrate surface may be achieved. In addition, the polishing method of the present invention adopts the polishing pad having the even tracking zone, thereby helping to provide a more uniform and planar substrate surface.

It will be apparent to persons of ordinary art in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A polishing pad, suitable for polishing a substrate, comprising:

a polishing layer, having an even tracking zone disposed around a rotational axis; and at least two grooves, disposed in the even tracking zone, and satisfying the following relation:

$$D_{(i)max} \cong D_{(i+n)min}$$

wherein, $D_{(i)max}$ is the largest distance from the rotational axis to the $(i)^{th}$ groove;

$D_{(i+n)min}$ is the smallest distance from the rotational axis to the $(i+n)^{th}$ groove; and i is an ordinal number of a groove counting from the groove closest to the rotational axis to an outer periphery of the even tracking zone, and n is an integer.

2. The polishing pad as claimed in claim 1, wherein the even tracking zone is disposed corresponding to a central portion of the substrate.

3. The polishing pad as claimed in claim 1, wherein the even tracking zone is substantially arranged in a middle region between an innermost portion and an outermost portion of the polishing pad.

4. The polishing pad as claimed in claim 1, wherein the even tracking zone has a width of at least 35 mm.

5. The polishing pad as claimed in claim 1, wherein the even tracking zone has an annular shape, and the annular shape has a geometrical center coinciding with the rotational axis.

6. The polishing pad as claimed in claim 1, wherein at least one of the grooves has a geometrical center not coinciding with the rotational axis.

7. The polishing pad as claimed in claim 1, wherein n=1-5.

8. The polishing pad as claimed in claim 1, wherein the grooves are enclosed grooves.

9. The polishing pad as claimed in claim 8, wherein the grooves are coaxial.

10. The polishing pad as claimed in claim 8, wherein the grooves are non-coaxial.

11. The polishing pad as claimed in claim 1, wherein the grooves have shapes selected from the group consisting of an elliptical shape, a polygonal shape, a corrugated shape, an annular shape having at least one protrusion and/or at least one recession, a circumferential shape, an irregular shape, and a combination thereof.

12. The polishing pad as claimed in claim 1, wherein the grooves are not interconnected.

13. The polishing pad as claimed in claim 1, wherein the grooves have a same pitch in a radial direction.

14. The polishing pad as claimed in claim 1, wherein at least two pitches of the grooves are different in a radial direction.

15. The polishing pad as claimed in claim 1, wherein at least one of the grooves comprises a plurality of discontinuous sub-grooves.

16. A polishing pad, suitable for polishing a substrate, comprising:

a polishing layer, having an even tracking zone; and at least two grooves, disposed in the even tracking zone, wherein each of the grooves forms one polishing track, and the polishing tracks are adjoining one another.

17. The polishing pad as claimed in claim 16, wherein the even tracking zone is disposed corresponding to a central portion of the substrate.

18. The polishing pad as claimed in claim 16, wherein the even tracking zone is substantially arranged in a middle region between an innermost portion and an outermost portion of the polishing pad.

19. The polishing pad as claimed in claim 16, wherein the even tracking zone has a width of at least 35 mm.

20. The polishing pad as claimed in claim 16, wherein the even tracking zone has an annular shape disposed around a rotational axis.

21. The polishing pad as claimed in claim 20, wherein the even tracking zone has a geometrical center coinciding with the rotational axis.

22. The polishing pad as claimed in claim 20, wherein at least one of the grooves has a geometrical center not coinciding with the rotational axis.

23. The polishing pad as claimed in claim 16, wherein the grooves are enclosed grooves.

24. The polishing pad as claimed in claim 23, wherein the grooves are coaxial.

25. The polishing pad as claimed in claim 23, wherein the grooves are non-coaxial.

26. The polishing pad as claimed in claim 16, wherein the grooves have shapes selected from the group consisting of an elliptical shape, a polygonal shape, a corrugated shape, an annular shape having at least one protrusion and/or at least one recession, a circumferential shape, an irregular shape, and a combination thereof.

27. The polishing pad as claimed in claim 16, wherein the grooves are not interconnected.

28. The polishing pad as claimed in claim 16, wherein at least two of the polishing tracks have different widths.

29. The polishing pad as claimed in claim 16, wherein at least one of the grooves comprises a plurality of discontinuous sub-grooves.

30. A polishing pad, suitable for polishing a substrate, comprising:

a polishing layer, having an even tracking zone, wherein the even tracking zone is divided into at least two polishing tracks adjoining one another; and at least one groove, disposed in each of the polishing tracks, wherein the at least one groove has a uniformly distributed trajectory in each of the polishing tracks.

31. The polishing pad as claimed in claim 30, wherein the even tracking zone is disposed corresponding to a central portion of the substrate.

32. The polishing pad as claimed in claim 30, wherein the even tracking zone is substantially arranged in a middle region between an innermost portion and an outermost portion of the polishing pad.

33. The polishing pad as claimed in claim 30, wherein the even tracking zone has a width of at least 35 mm.

34. The polishing pad as claimed in claim 30, wherein the even tracking zone has an annular shape disposed around a rotational axis.

35. The polishing pad as claimed in claim 34, wherein the even tracking zone has a geometrical center coinciding with the rotational axis.

36. The polishing pad as claimed in claim 34, wherein at least one of the grooves has a geometrical center not coinciding with the rotational axis.

37. The polishing pad as claimed in claim 30, wherein the grooves are enclosed grooves.

38. The polishing pad as claimed in claim 37, wherein the grooves are coaxial.

39. The polishing pad as claimed in claim 37, wherein the grooves are non-coaxial.

40. The polishing pad as claimed in claim 30, wherein the grooves have shapes selected from the group consisting of an elliptical shape, a polygonal shape, a corrugated shape, an annular shape having at least one protrusion and/or at least one recession, a circumferential shape, an irregular shape, and a combination thereof.

41. The polishing pad as claimed in claim 30, wherein the groove in one polishing track is not interconnected with the groove in another polishing track.

42. The polishing pad as claimed in claim 30, wherein at least two of the polishing tracks have different widths.

43. The polishing pad as claimed in claim 30, wherein at least one of the polishing tracks has at least two grooves formed therein.

44. The polishing pad as claimed in claim 43, wherein the at least two grooves are arranged in symmetry.

45. The polishing pad as claimed in claim 30, wherein at least one of the polishing tracks has two elliptical grooves formed therein.

46. The polishing pad as claimed in claim 45, wherein major axes of the two elliptical grooves are perpendicular to each other.

47. The polishing pad as claimed in claim 30, wherein at least one of the grooves comprises a plurality of discontinuous sub-grooves.

48. A polishing method, suitable for polishing a substrate, comprising:

providing a polishing pad;

applying a pressure on the substrate to press the substrate on the polishing pad; and providing a relative motion between the substrate and the polishing pad, wherein the the polishing pad comprises:

a polishing layer, having an even tracking zone disposed around a rotational axis; and at least two grooves, disposed in the even tracking zone, and satisfying the following relation:

$$D_{(i)max} \cong D_{(i+n)min}$$

wherein, $D_{(i)max}$ is the largest distance from the rotational axis to the $(i)^{th}$ groove;

$D_{(i+n)min}$ is the smallest distance from the rotational axis to the $(i+n)^{th}$ groove; and i is an ordinal number of a groove counting from the groove closest to the rotational axis to an outer periphery of the even tracking zone, and n is an integer.

49. The polishing method as claimed in claim 48, wherein a central portion of the substrate is corresponding to the even tracking zone.

50. The polishing method as claimed in claim 48, wherein the grooves are not interconnected.

51. The polishing method as claimed in claim 50, wherein each of the grooves forms one polishing track.

52. The polishing method as claimed in claim 51, further comprising providing slurries or solutions with different properties corresponding to one polishing track and another polishing track respectively.

53. A polishing method, suitable for polishing a substrate, comprising:

providing a polishing pad;

applying a pressure on the substrate to press the substrate on the polishing pad; and providing a relative motion between the substrate and the polishing pad, wherein the polishing pad comprises:

a polishing layer, having an even tracking zone; and at least two grooves, disposed in the even tracking zone, wherein each of the grooves forms one polishing track, and the polishing tracks are adjoining one another.

54. The polishing method as claimed in claim 53, wherein a central portion of the substrate is corresponding to the even tracking zone.

55. The polishing method as claimed in claim 53, wherein the grooves are not interconnected.

56. The polishing method as claimed in claim 55, further comprising providing slurries or solutions with different properties corresponding to one polishing track and another polishing track respectively.

57. A polishing method, suitable for polishing a substrate, comprising:

providing a polishing pad;

applying a pressure on the substrate to press the substrate on the polishing pad; and providing a relative motion between the substrate and the polishing pad, wherein the polishing pad comprises:

a polishing layer, having an even tracking zone, wherein the even tracking zone is divided into at least two polishing tracks adjoining one another; and at least one groove, disposed in each of the polishing tracks, wherein the at least one groove has a uniformly distributed trajectory in each of the polishing tracks.

58. The polishing method as claimed in claim 57, wherein a central portion of the substrate is corresponding to the even tracking zone.

59. The polishing method as claimed in claim 57, wherein the groove in one polishing track is not interconnected with the groove in another polishing track.

60. The polishing method as claimed in claim 59, further comprising providing slurries or solutions with different properties corresponding to a polishing track and another polishing track respectively.

* * * * *